US011619131B2

(12) United States Patent
Pu et al.

(10) Patent No.: US 11,619,131 B2
(45) Date of Patent: Apr. 4, 2023

(54) SIX-ARM TUNNELING AND ANCHORING MACHINE FOR INTEGRATING TUNNELING AND ANCHORING

(71) Applicant: LANG FANG JING LONG GRAND INDUSTRIAL MACHINERY CO., LTD., Hebei (CN)

(72) Inventors: Changyan Pu, Hebei (CN); Limin Wu, Hebei (CN); Qi Liu, Hebei (CN); Yaohui Fan, Hebei (CN); Zhiguo Jing, Hebei (CN); Zhonghua Ren, Hebei (CN); Jingbo Cui, Hebei (CN)

(73) Assignee: LANG FANG JING LONG GRAND INDUSTRIAL MACHINERY CO., LTD., Hebei (CN)

( * ) Notice: Subject to any disclaimer, the term of this patent is extended or adjusted under 35 U.S.C. 154(b) by 0 days.

(21) Appl. No.: 17/425,344

(22) PCT Filed: Jan. 10, 2020

(86) PCT No.: PCT/CN2020/071442
§ 371 (c)(1),
(2) Date: Jul. 23, 2021

(87) PCT Pub. No.: WO2020/151504
PCT Pub. Date: Jul. 30, 2020

(65) Prior Publication Data

US 2022/0090498 A1 Mar. 24, 2022

(30) Foreign Application Priority Data

Jan. 25, 2019 (CN) ..... 201910074587.3

(51) Int. Cl.
*E21D 20/00* (2006.01)
*E21C 27/22* (2006.01)
(Continued)

(52) U.S. Cl.
CPC ..... *E21D 20/003* (2013.01); *E21B 7/025* (2013.01); *E21C 27/22* (2013.01); *E21D 9/102* (2013.01);
(Continued)

(58) Field of Classification Search
CPC ..... E21D 9/1013; E21D 9/102; E21D 9/1026; E21D 9/1033; E21D 9/106; E21D 20/00;
(Continued)

(56) References Cited

U.S. PATENT DOCUMENTS 3,493,058 A * 2/1970 Zitko ..... E21D 20/003 299/33
8,342,267 B1 * 1/2013 Hinshaw ..... E21D 20/003 175/219
(Continued)

FOREIGN PATENT DOCUMENTS

CN 101230781 A 7/2008
CN 201443396 U 4/2010
(Continued)

OTHER PUBLICATIONS

The first office action of patent family AU application dated Apr. 22, 2022.

*Primary Examiner* — Abby J Flynn
*Assistant Examiner* — Michael A Goodwin
(74) *Attorney, Agent, or Firm* — Gang Yu

(57) ABSTRACT

Some embodiments of the present disclosure provide a six-arm tunneling and anchoring machine for integrating tunneling and anchoring, which includes: a tunneling machine and a roof-bolter connected with each other. The roof-bolter includes roof bolt units, a side bolt unit, and a working platform unit. The tunneling machine includes a frame body, a walking part, a cutting part, a revolving body, a rear support body, a loading mechanism, a conveyor, an
(Continued)

electronic control system, a hydraulic system, a spraying system and a cooling system. There are two sets roof bolt units, which are symmetrically arranged on the left and right sides of the frame body, and are located behind a revolving center of the revolving body. Each roof bolt unit is provided with two top anchor bolts.

9 Claims, 6 Drawing Sheets

(51) Int. Cl.

| | |
|---|---|
| ***E21B 7/02*** | (2006.01) |
| ***E21D 9/10*** | (2006.01) |
| *E21C 27/00* | (2006.01) |
| *E21C 35/00* | (2006.01) |
| *E21C 35/20* | (2006.01) |

(52) U.S. Cl.
CPC ..... *E21C 27/00* (2013.01); *E21C 35/00* (2013.01); *E21C 35/20* (2013.01)

(58) Field of Classification Search
CPC ..... E21D 20/003; E21D 20/006; E21B 7/025; E21C 27/00; E21C 27/22; E21C 27/24; E21C 35/00; E21C 35/20
See application file for complete search history.

(56) References Cited

U.S. PATENT DOCUMENTS

2011/0193398 A1* 8/2011 Meier ..... E21D 20/021 299/29
2017/0298731 A1* 10/2017 Galler ..... E21C 35/20

FOREIGN PATENT DOCUMENTS

| | | | | | |
|---|---|---|---|---|---|
| CN | 201696041 | U | | 1/2011 | |
| CN | 106194201 | A | * | 12/2016 | ..... E21D 20/003 |
| CN | 106194201 | A | | 12/2016 | |
| CN | 206785394 | U | | 12/2017 | |
| CN | 109736798 | A | | 5/2019 | |
| DE | 19649108 | A1 | | 5/1998 | |
| GB | 2228755 | A | * | 9/1990 | ..... E21D 20/003 |
| GB | 2228755 | A | | 9/1990 | |

* cited by examiner

SIX-ARM TUNNELING AND ANCHORING MACHINE FOR INTEGRATING TUNNELING AND ANCHORING

TECHNICAL FIELD

The disclosure relates to a technical field of coal mining equipment, and in particular to a six-arm tunneling and anchoring machine for integrating tunneling and anchoring. The disclosure claims priority to the application No. 201910074587.3, filed to the China National Intellectual Property Administration on Jan. 25, 2019 and entitled "Six-Arm Tunneling and Anchoring Machine for Integrating Tunneling and Anchoring".

BACKGROUND

In a process of coal mining, if a common tunneling machine is used, it is needed to move away the tunneling machine after a certain tunneling distance, and then support a roof and sides with bolts; and after a completion of the support, the tunneling machine is moved to a tunneling position to carry out tunneling work. The work efficiency of the tunneling machine is low, the labor intensity of workers is high, and danger is easy to happen.

SUMMARY

The main purpose of the disclosure is to provide a six-arm tunneling and anchoring machine for integrating tunneling and anchoring to solve a problem of low tunneling and anchoring efficiency in the prior art.

To achieve the purpose, according to an aspect of the disclosure, some embodiments of the present disclosure provide a six-arm tunneling and anchoring machine for integrating tunneling and anchoring, which includes: a tunneling machine and a roof-bolter connected to each other. The roof-bolter includes roof bolt units, a side bolt unit, and a working platform group. The tunneling machine includes a frame body, a walking part, a cutting part, a revolving body, a rear support body, a loading mechanism, a conveyor, an electronic control system, a hydraulic system, a spraying system and a cooling system. There are two sets roof bolt units, which are symmetrically arranged on the left and right sides of the frame body, and are located behind a revolving center of the revolving body. Each roof bolt unit is provided with two top anchor bolts. There is one side bolt unit, which is movably disposed on the frame body, and is located behind the cutting part. There are two side bolt drillers on the side bolt unit. The working platform group is connected with the cutting part, and is located above the cutting part.

In some embodiments, the each roof bolt unit includes a primary retractable sleeve, a secondary retractable sleeve, a primary retractable oil cylinder, and a secondary retractable oil cylinder. The primary retractable sleeve slides back and forth along a guide rail and a support roller installed on the walking part. The primary retractable sleeve and the secondary retractable sleeve are respectively driven by the primary retractable oil cylinder and the secondary retractable oil cylinder to do retractable motion back and forth.

In some embodiments, the each roof bolt unit further includes a first rotating oil cylinder, a rotating base, a top anchor bolt, a first oil cylinder swinging back and forth, an oil cylinder swinging from side to side, a driller mounting base and a support oil cylinder. The first rotating oil cylinder is mounted on a front end of the secondary retractable oil cylinder. The rotating base is connected with the first rotating oil cylinder. The first rotating oil cylinder is capable of driving the rotating base to rotate. The driller mounting base is hinged to the rotating base. The two top anchor bolts of each roof bolt unit are respectively hinged to the rotating base symmetrically through the driller mounting base. One end of the first oil cylinder swinging back and forth is hinged on the rotating base, and the other end of the first oil cylinder swinging back and forth is hinged on the driller mounting base. One end of the oil cylinder swinging from side to side is hinged on the driller mounting base, and the other end is hinged on the top anchor bolt. The support oil cylinder is mounted on the rotating base.

In some embodiments, the side bolt unit further includes a portal support, a retractable outer sleeve, a retractable inner sleeve, a retractable oil cylinder and a lifting oil cylinder. The portal support is mounted on the rear support body, and straddles the upper rear end of the conveyor. The retractable outer sleeve is hinged on the portal support. One end of the retractable oil cylinder is hinged with the retractable outer sleeve, and the other end is hinged on the retractable inner sleeve. One end of the lifting oil cylinder is hinged on the retractable outer sleeve, and the other end of the lifting oil cylinder is hinged on the frame body.

In some embodiments, the side bolt unit further includes two second rotating oil cylinders. The two second rotating oil cylinders are symmetrically mounted on left and right sides of a front end of the retractable inner sleeve. The two side bolt drillers are respectively mounted on the second rotating oil cylinders.

In some embodiments, the working platform group includes a large platform, a connecting rod and a leveling oil cylinder. One end of the connecting rod is hinged on the cutting part, and the other end of the connecting rod is hinged on the large platform. One end of the leveling oil cylinder is hinged on the cutting part, and the other end of the connecting rod is hinged on the large platform.

In some embodiments, the working platform group further includes a turning plate, a retractable turning plate, a second oil cylinder swinging back and forth, a turning plate oil cylinder and a retractable turning plate oil cylinder. One end of the second oil cylinder swinging back and forth is hinged on the cutting part, and the other end of the second oil cylinder swinging back and forth is hinged on the leveling oil cylinder. The turning plate is hinged with the large platform. The turning plate oil cylinder drives the turning plate to do turning motion. The retractable turning plate is built in the turning plate. The retractable turning plate oil cylinder drive the retractable turning plate to do retractable motion relative to the large platform.

In some embodiments, there are two turning plates, which are respectively disposed at a left side and a right side of the large platform movably.

In some embodiments, there are two retractable turning plates, one of the two retractable turning plates is movably connected with the turning plate at the left side of the large platform, and the other of the two retractable turning is movably connected with the turning plate at the right side of the large platform.

In some embodiments, the hydraulic system provides power to the tunneling machine and the roof-bolter.

By applying the technical solution of the disclosure and using the six-arm tunneling and anchoring machine for integrating tunneling and anchoring, the problems of time waste caused by the separate work of the tunneling machine and the roof-bolter as well as the high labor intensity and low efficiency of manually drilling and installing bolts are solved, and the integrated effect of the tunneling machine and the roof-bolter is realized. And the problem of manual drilling and bolt installation with a single bolt drilling and installing machine in the comprehensive excavation of coal is solved, the unsupported roof and side bolting time is reduced, a support requirement for tunneling in the unsupported roof area is met, the safety of workers is guaranteed, and the degree of mechanical automation is improved.

BRIEF DESCRIPTION OF THE DRAWINGS

The drawings attached to the specification constituting a part of the disclosure are used for providing further understanding of the disclosure. Schematic embodiments of the disclosure and description thereof are used for illustrating the disclosure and not intended to form an improper limit to the disclosure. In the accompanying drawings.

Figure 1:
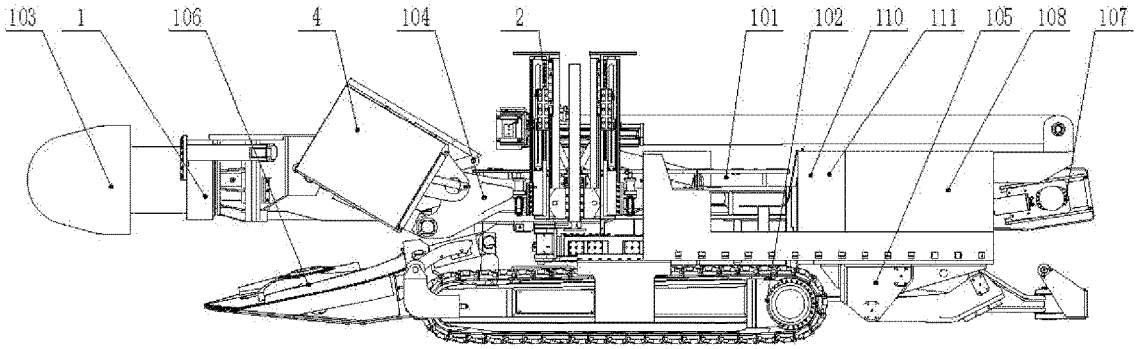
FIG. 1 illustrates a side-view structure diagram of an embodiment of a six-arm tunneling and anchoring machine in a retracted state according to the present disclosure.
Figure 2:
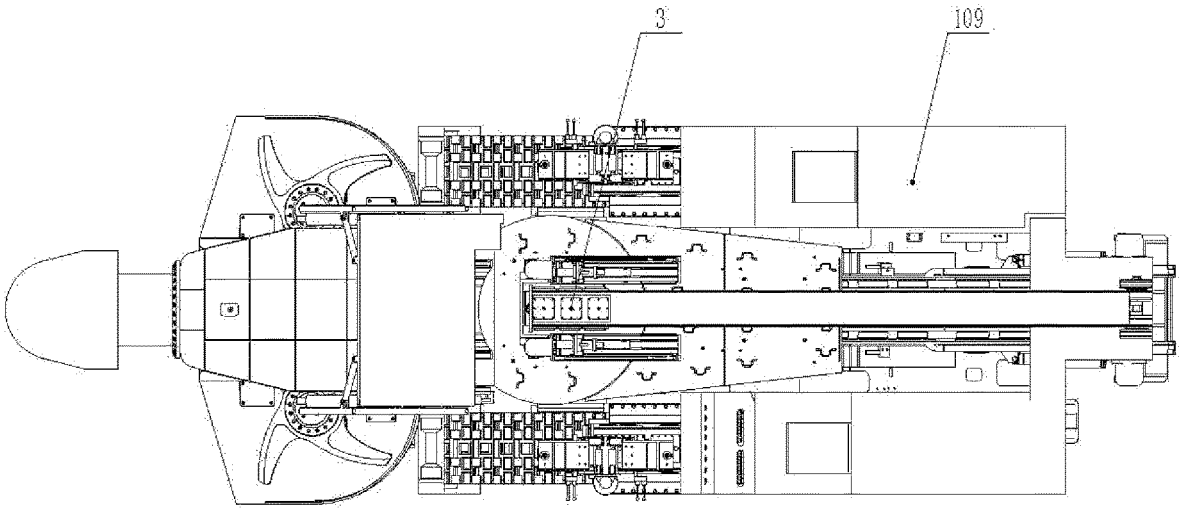
FIG. 2 illustrates a top-view structure diagram of an embodiment of a six-arm tunneling and anchoring machine in a retracted state according to the present disclosure.

In the drawings, 1. tunneling machine; 101, frame body; 102. walking part; 103. cutting part; 104. revolving body; 105. rear support body; 106. loading mechanism; 107. conveyor; 108. electronic control system; 109. hydraulic system; 110. spraying system; 111. cooling system;

2. roof bolt unit; 201. primary retractable sleeve; 202. primary retractable oil cylinder; 203. secondary retractable oil cylinder; 204. top anchor bolt; 209. top anchor bolt; 214. top anchor bolt; 215. top anchor bolt; 205. driller mounting base; 208. driller mounting base; 206. support oil cylinder; 207. first oil cylinder swinging back and forth; 216. first oil cylinder swinging back and forth; 210. support roller; 211. first rotating oil cylinder; 212. secondary retractable sleeve; 213. rotating base; 217. oil cylinder swinging from side to side; 218. oil cylinder swinging from side to side; 219. fixed guide rail;

3. side bolt unit; 301. portal support; 302. retractable outer sleeve; 303. retractable oil cylinder; 304. retractable inner sleeve; 305. secondary rotating oil cylinder; 309. secondary rotating oil cylinder; 306. side bolt driller; 308. side bolt driller; 307. lifting oil cylinder;

4. working platform group; 401. second oil cylinder swinging back and forth; 402. connecting rod; 403. leveling oil cylinder; 404. large platform; 405. turning plate; 409. turning plate; 406. retractable turning plate; 410. retractable turning plate; 407. retractable turning plate oil cylinder; 412. retractable turning plate oil cylinder; 408. turning plate oil cylinder; and 411. turning plate oil cylinder.

DETAILED DESCRIPTION OF THE EMBODIMENTS

It is to be noted that the embodiments in the disclosure and characteristics in the embodiments may be combined without conflicts. The disclosure will be described below with reference to the drawings and in combination with the embodiments in detail.

It is to be noted that terms used herein are only to describe specific embodiments, and are not intended to limit the exemplary embodiments of the disclosure. As used herein, unless otherwise explicitly indicated in the context, a singular form is also intended to include a plural form. In addition, it is also to be understood that when the terms "include" and/or "have" are used in the description, they are intended to indicate the presence of features, steps, operations, devices, components, and/or combinations thereof.

It should be noted that the specification and claims of the disclosure and terms "first", "second", etc. in the foregoing drawings are used for distinguishing similar objects rather than describing a specific sequence or a precedence order. It will be appreciated that the terms used in such a way may be exchanged under appropriate conditions, in order that the embodiments of the disclosure described here can be implemented in a sequence other than sequences graphically shown or described here. In addition, terms "include" and "have" and any variations thereof are intended to cover non-exclusive inclusions. For example, it is not limited for processes, methods, systems, products or devices containing a series of steps or units to clearly list those steps or units, and other steps or units which are not clearly listed or are inherent to these processes, methods, products or devices may be included instead.

For convenient description, spatially relativity terms such as "on", "above", "on the surface of", "on the top of" may be used herein to describe the spatial positional relationship of one device or one feature to other devices or features as shown in the drawings. It will be understood that the spatially relativity terms are intended to encompass different orientations used or operated in addition to the orientations of the devices described in the drawings. For example, if the device in the drawings is inverted, the device described as "on other devices or configurations" or "above other devices or configurations" will then be positioned "under other devices or configurations" or "below other devices or configurations". Thus, the exemplary term "above" may include both orientations of "above" and "below". The device may also be positioned in other different ways (rotated 90° or at other orientations) and the spatially relativity description used herein is interpreted accordingly.

Exemplary embodiments according to the disclosure will now be described in more detail with reference to the accompanying drawings. However, the exemplary embodiments may be implemented in many different forms and should not be construed as being only limited to the embodiments set forth herein. It is to be understood that the embodiments are provided so that the disclosure of the disclosure may be thorough and complete, and the concept of the exemplary embodiments may be fully conveyed to those of ordinary skill in the art. In the drawings, for clarity, the thicknesses of layers and regions may be enlarged, and the same reference numerals are used to denote the same devices, and thus the description thereof is omitted.

In combination with FIG. 1 to FIG. 10, according to the embodiments of the disclosure, a six-arm tunneling and anchoring machine for integrating tunneling and anchoring is provided.

In some embodiments, as shown in FIG. 1, the six-arm tunneling and anchoring machine includes a tunneling machine 1 and a roof-bolter connected with each other. The roof-bolter includes roof bolt units 2, a side bolt unit 3, and a working platform group 4. The tunneling machine 1 includes a frame body 101, a walking part 102, a cutting part 103, a revolving body 104, a rear support body 105, a loading mechanism 106, a conveyor 107, an electronic control system 108, a hydraulic system 109, a spraying system 110 and a cooling system 111. There are two sets roof bolt units 2, which are symmetrically arranged on the left and right sides of the frame body 101, and are located behind a revolving center of the revolving body 104. Each roof bolt unit 2 is provided with two top anchor bolts, that is, there is a total of four top anchor bolts (204, 209, 214, 215). There is one side bolt unit 3, which is movably disposed on the frame body 101, and is located behind the cutting part 103. There are two side bolt drillers on the side bolt unit 3. The working platform group 4 is connected with the cutting part 103, and is located above the cutting part 103.

In some embodiments, by using the six-arm tunneling and anchoring machine for integrating tunneling and anchoring, the problems of time waste caused by the separate work of the tunneling machine and the roof-bolter as well as the high labor intensity and low efficiency of manually drilling and installing bolts are solved, and the integrated effect of the tunneling machine and the roof-bolter is realized. And the problem of using a single bolt drilling machine to drill and install bolts manually in the comprehensive excavation of coal is solved, the unsupported roof and side bolting time is reduced, a support requirement for tunneling in the unsupported roof area is met, the safety of workers is guaranteed, and the degree of mechanical automation is improved.

According to the first embodiment of the disclosure, the roof bolt unit 2 includes a primary retractable sleeve 201, a secondary retractable sleeve 212, a primary retractable oil cylinder 202, and a secondary retractable oil cylinder 203. The primary retractable sleeve 201 slides back and forth along a guide rail and a support roller 210 installed on the walking part 102. The primary retractable sleeve 201 and the secondary retractable sleeve 212 are respectively driven by the primary retractable oil cylinder 202 and the secondary retractable oil cylinder 203 to do retractable motion back and forth.

In some embodiments, as shown in FIG. 1 to FIG. 4, the roof bolt unit 2 further includes a first rotating oil cylinder 211, a rotating base 213, a top anchor bolt, a first oil cylinder swinging back and forth (207, 216), an oil cylinder swinging from side to side (217, 218), a driller mounting base (205, 208) and a support oil cylinder 206. The first rotating oil cylinder 211 is mounted on a front end of the secondary retractable sleeve 212. The rotating base 213 is connected with the first rotating oil cylinder 211. The first rotating oil cylinder 211 is capable of driving the rotating base 213 to rotate. The driller mounting base is hinged to the rotating base 213. The two top anchor bolts of each roof bolt unit 2 are respectively hinged on the rotating base symmetrically through the driller mounting base 213. One end of the first oil cylinder swinging back and forth is hinged on the rotating base 213, and the other end of the first oil cylinder swinging back and forth is hinged on the driller mounting base. One end of the oil cylinder swinging from side to side is hinged on the driller mounting base, and the other end is hinged on the top anchor bolt. The support oil cylinder 206 is mounted on the rotating base 213.

Figure 5:
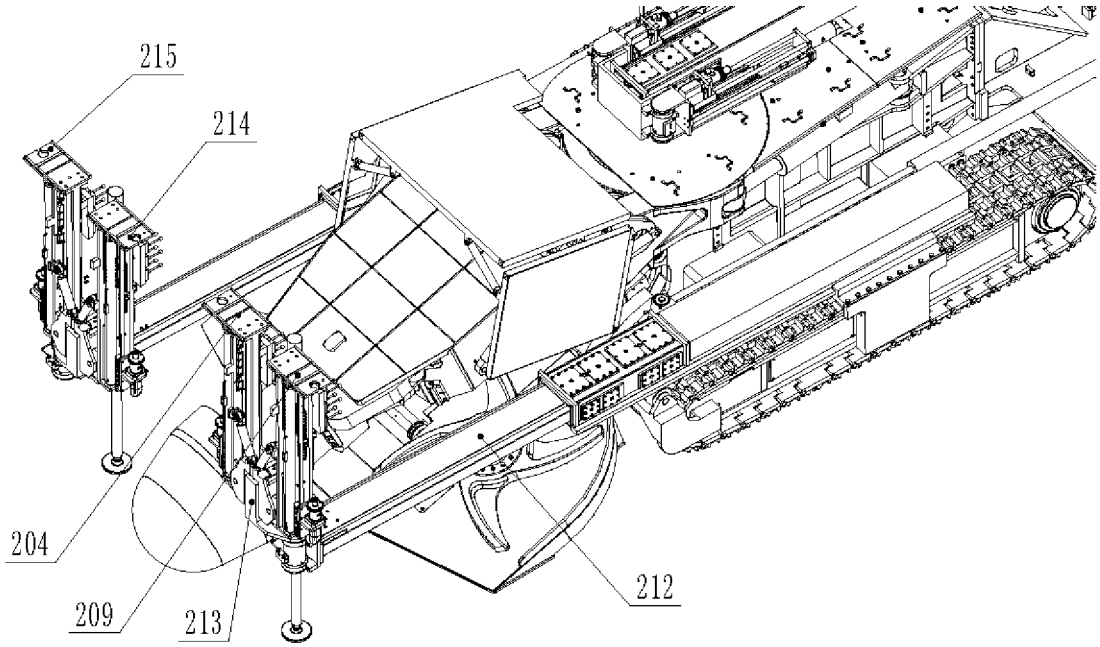
FIG. 5 illustrates a structure diagram of an embodiment of a roof bolt unit in an expanded operating state according to the present disclosure.

As shown in FIG. 5, the side bolt unit 3 further includes a portal support 301, a retractable outer sleeve 302, a retractable inner sleeve 304, a retractable oil cylinder 303 and a lifting oil cylinder 307. The portal support 301 is mounted on the rear support body 105, and straddles the upper rear end of the conveyor 107. The retractable outer sleeve 302 is hinged on the portal support 301. One end of the retractable oil cylinder 303 is hinged with the retractable outer sleeve 302, and the other end is hinged on the retractable inner sleeve 304. One end of the lifting oil cylinder 307 is hinged on the retractable outer sleeve 302, and the other end of the lifting oil cylinder 307 is hinged on the frame body 101. This arrangement can improve the stability of the six-arm tunneling and anchoring machine for integrating tunneling and anchoring.

In some embodiments, the side bolt unit 3 further includes two second rotating oil cylinders. The two second rotating oil cylinders (305, 309) are symmetrically mounted on the left and right sides of the front end of the retractable inner sleeve 304. The two side bolt drillers are respectively mounted on the second rotating oil cylinders. This arrangement can further improve the stability of the six-arm tunneling and anchoring machine for integrating tunneling and anchoring.

Figure 7:
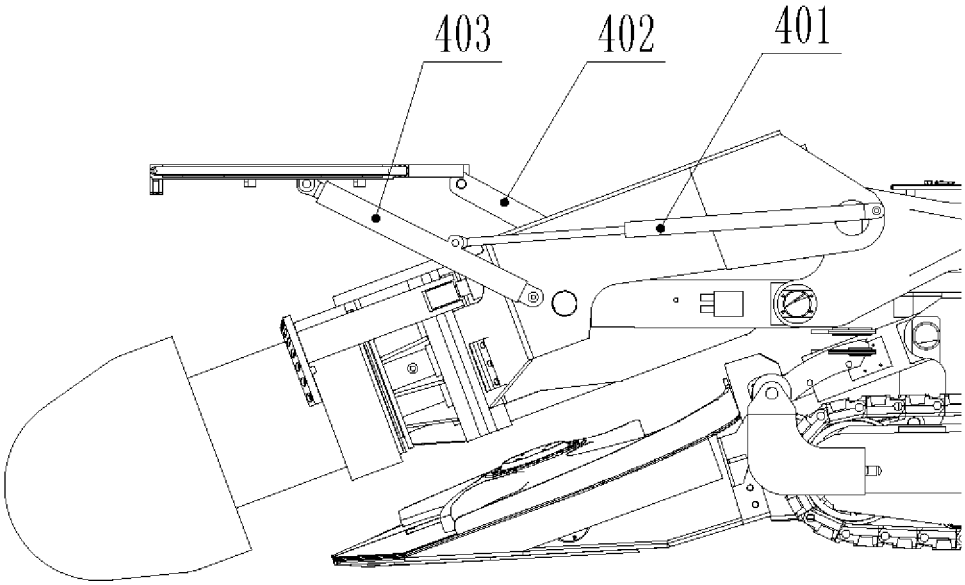
FIG. 7 illustrates a side-view structure diagram of an embodiment of a working platform group in an expanded operating state according to the present disclosure.
Figure 8:
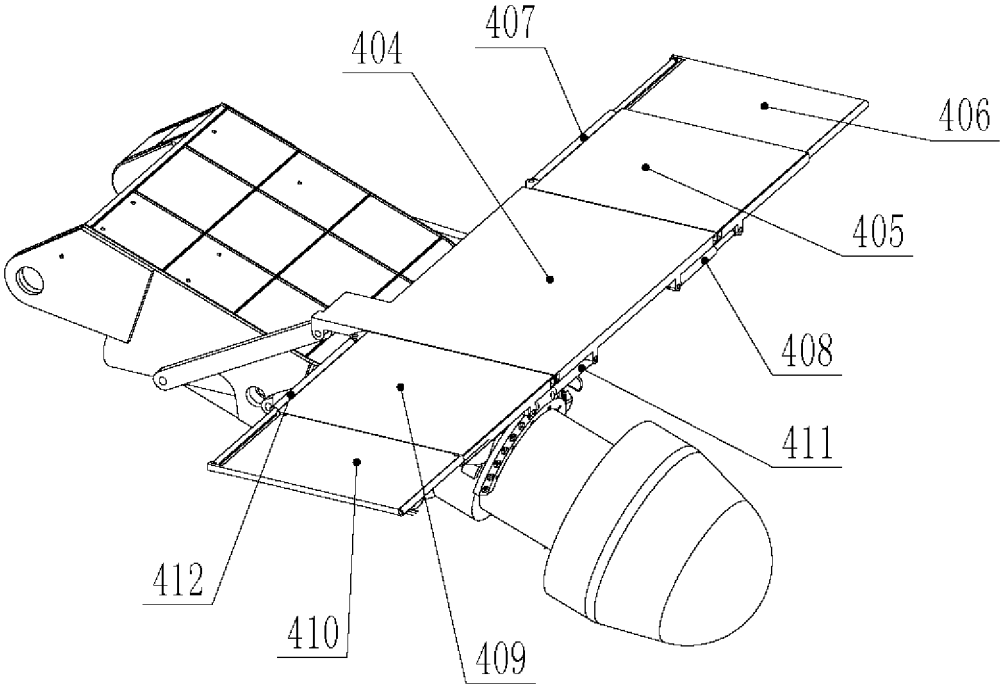
FIG. 8 illustrates a structure diagram of an embodiment of a working platform group in an expanded operating state according to the present disclosure.

As shown in FIG. 7 and FIG. 8, the working platform group 4 includes a large platform 404, a connecting rod 402 and a leveling oil cylinder 403. One end of the connecting rod 402 is hinged on the cutting part 103, and the other end is hinged on the large platform 404. One end of the leveling oil cylinder 403 is hinged on the cutting part 103, and the other end is hinged on the large platform 404. This arrangement can improve the reliability of the large platform 404.

In some embodiments, the working platform group 4 further includes a turning plate, a retractable turning plate, a second oil cylinder swinging back and forth 401, a turning plate oil cylinder and a retractable turning plate oil cylinder. One end of the second oil cylinder swinging back and forth 401 is hinged on the cutting part 103, and the other end is hinged on the leveling oil cylinder 403. The turning plate is hinged with the large platform 404. The turning plate oil cylinder drives the turning plate to do turning motion. The retractable turning plate is built in the turning plate. The retractable turning plate oil cylinder drives the retractable turning plate to do retractable motion relative to the large platform 404. This arrangement can drive, through a driving cylinder, the turning plate and retractable plate to move when it is needed to increase the movement space of operators, thus improving the practicability and reliability of the six-arm tunneling and anchoring machine.

In some embodiments, there are two turning plates (405, 409), which are respectively disposed at a left side and a right side of the large platform 404 movably. There are two retractable turning plates (406, 410), one of which is movably connected with the turning plate at the left side of the large platform 404, and the other is movably connected with the turning plate at the right side of the large platform 404.

In some embodiments, the hydraulic system 109 provides power to the tunneling machine 1 and the roof-bolter. This arrangement can improve the stability and reliability of the six-arm tunneling and anchoring machine for integrating tunneling and anchoring.

According to the present disclosure, some embodiments of the present disclosure provide a six-arm tunneling and anchoring machine for integrating tunneling and anchoring, which solves the problems of time waste caused by the separate work of the tunneling machine and the roof-bolter as well as the high labor intensity and low efficiency of manually drilling and installing bolts are solved, and realizes the integrated effect of the tunneling machine and the roof-bolter. This machine replaces the manual drilling and bolt installation with a single bolt drilling and installing machine in the present comprehensive excavation of coal, reduces the unsupported roof and side bolting time, meets a support requirement for tunneling in the unsupported roof area, guarantees the safety of workers, and improves the degree of mechanical automation. There is no need to move the whole tunneling and anchoring machine when installing the roof bolt and the side bolt, and the purpose can be achieved just by adjusting the positions of the top anchor bolt and the side bolt driller, so the operation is simple, the efficiency of tunneling and support in tunnels is improved, and the service life of the tunneling and anchoring machine is prolonged.

The working platform group is arranged above the cutting part to provide a working space for the workers during the bolt construction. When the tunneling and anchoring machine is tunneling and cutting, the roof-bolter retracts and folds to reduce the space size of the roof-bolter to the greatest extent. After the completion of the cutting operation of the tunneling and anchoring machine, there is no need to move the whole machine, and it is only needed to expand, rotate and swing the roof-bolter to unfold it, and then it reaches the front-end operation position to perform a bolt support operation, thus significantly improving the working efficiency of tunneling and support in the tunnel.

According to the second embodiment of the disclosure, the six-arm tunneling and anchoring machine for integrating tunneling and anchoring includes a tunneling machine 1, a roof bolt unit 2, a side bolt unit 3 and a working platform group 4. The tunnel machine 1 includes a frame body 101, a walking part 102, a cutting part 103, a revolving body 104, a rear support body 105, a loading mechanism 106, a conveyor 107, an electronic control system 108, a hydraulic system 109, a spraying system 110, and a cooling system 111. The tunneling machine 1, the roof bolt unit 2, the side bolt unit 3 and the working platform group 4 share one hydraulic system 109. There are two roof bolt units 2 which are symmetrically arranged at two sides of the frame body 101 and behind the revolving center of the revolving body 104. The side bolt unit 3 is arranged in the middle of the upper part of the frame body 101 and behind the cutting part 103. The working platform group 4 is mounted on the upper part of the cutting part 103.

Figure 3:
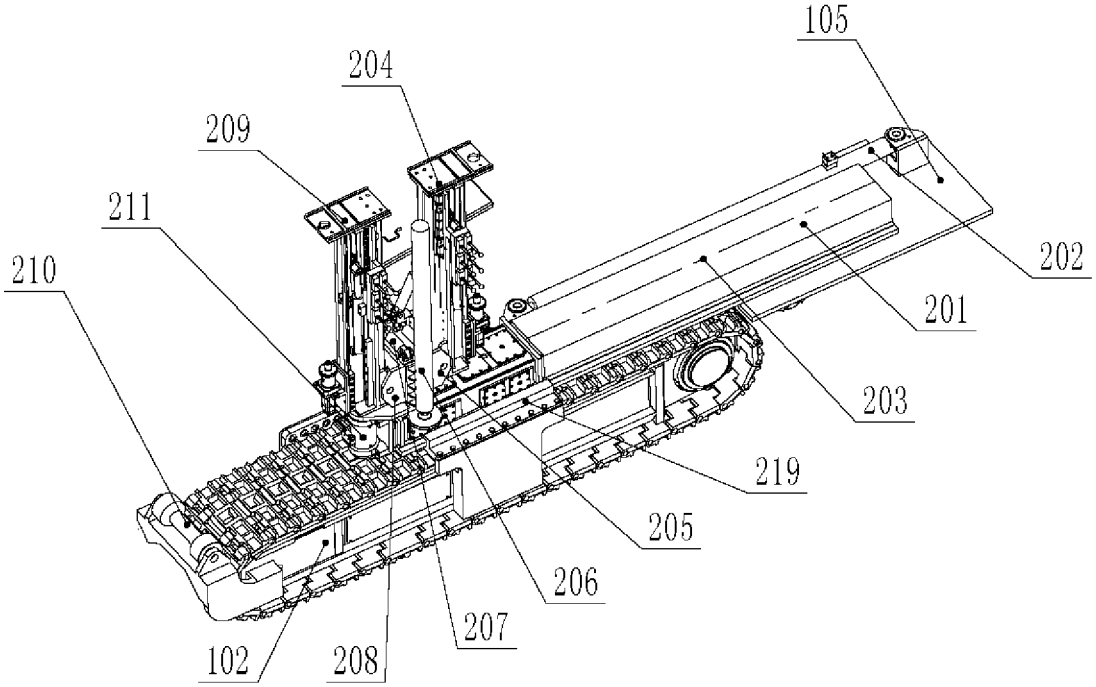
FIG. 3 illustrates a structure diagram of an embodiment of a roof bolt unit in a retracted state according to the present disclosure.
Figure 4:
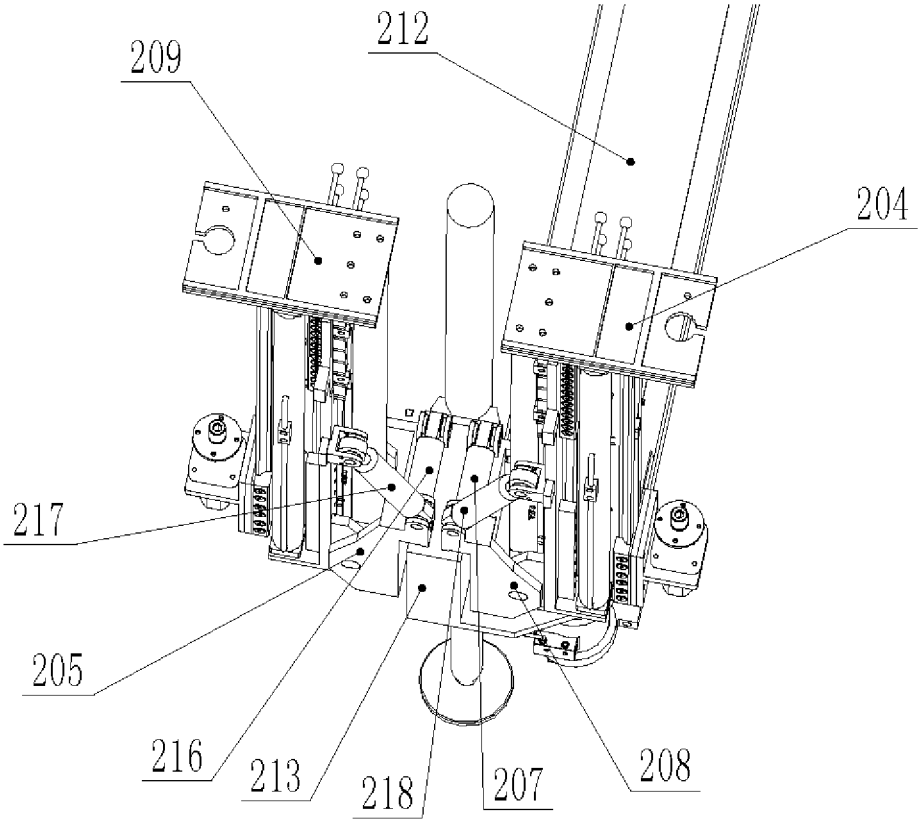
FIG. 4 illustrates a local structure diagram of an embodiment of a roof bolt unit in an expanded operating state according to the present disclosure.

There are two roof bolt units 2 which are symmetrical and have the same structure type. Now, only one of the two roof bolt unit is illustrated in the accompanying drawings. As shown in FIG. 3, FIG. 4 and FIG. 5, the roof bolt unit 2 mainly includes the primary retractable sleeve 201, the secondary retractable sleeve 212, the primary retractable oil cylinder 202, the secondary retractable oil cylinder 203, the first rotating oil cylinder 211, the rotating base 213, the top anchor bolts (204, 209), the first oil cylinders swinging back and forth (207, 216), the oil cylinders swinging from side to side (217, 218), the driller mounting bases (205, 208), and the support oil cylinder 206. The primary retractable sleeve 201 is driven by the primary retractable oil cylinder 202 to slide back and forth along the fixed guide rail 219. After the primary retractable sleeve 201 slides forward for a distance to reach the upper part of the support roller 210, the support roller 210 plays a guiding and supporting role to prevent the problem that the rigidity gets weaker caused by over-long cantilever after the primary retractable sleeve 201 and the secondary retractable sleeve 212 slide forward. Both the fixed guide rail 219 and the support roller 210 are mounted on the walking part 102 respectively. When a construction operation of roof bolt is required, the primary retractable sleeve 201 and the secondary retractable sleeve 212 slide forward respectively under the drive of the primary retractable oil cylinder 202 and the secondary retractable oil cylinder 203 to reach the operating position, and under the drive of the first rotating oil cylinder 211, the top anchor bolts (204, 209) rotate 90° inwards with the rotating base 213, then the support oil cylinder 206 extends out and effectively supports the base board. In this way, the stability of the whole roof bolt unit 2 of the top anchor bolts (204, 209) during drilling can be greatly improved. The top anchor bolts (204, 209) are respectively mounted on the rotating base 213 through the rig driller mounting bases (208, 205). Under the drive of the first oil cylinders swinging back and forth (207, 216), the driller mounting bases (208, 205) enable the top anchor bolts (204, 209) to swing back and forth independently. The top anchor bolts (204, 209) can swing from side to side independently under the drive of the oil cylinders swinging from side to side (217, 218). The swing back and forth and the swing from side to side of the top anchor bolts (204, 209) makes it easy and fast to locate the drilling position, thus improving the working efficiency. When a construction operation of roof bolt is carried out, the four top anchor bolts (204, 209, 214, 215) of the left and right top anchor bolt units 2 are lined up, and can carry out a roof bolt and anchor cable operation at the same time, thus greatly improving the work efficiency.

Figure 6:
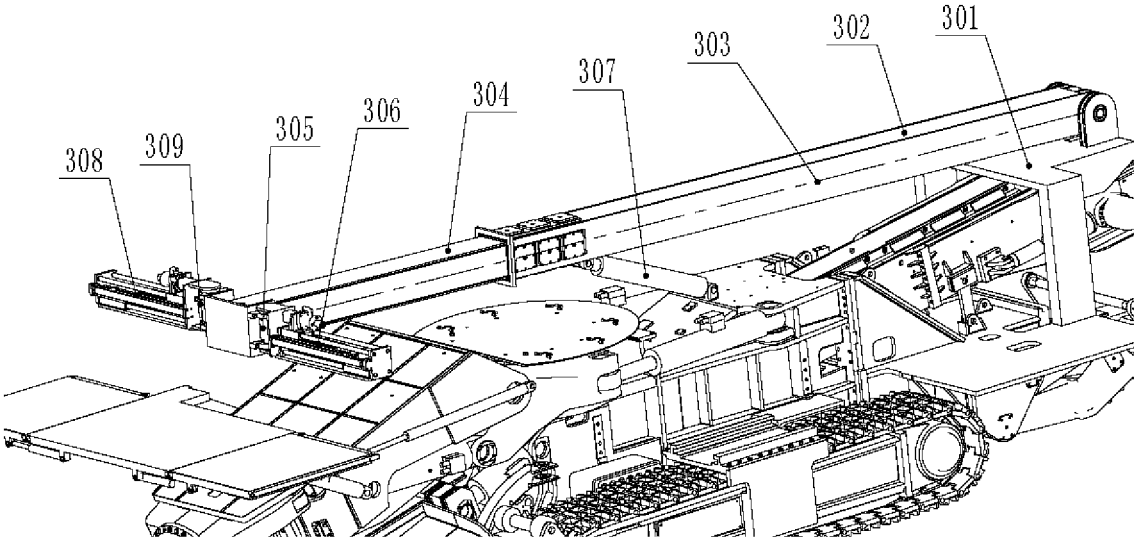
FIG. 6 illustrates a structure diagram of an embodiment of a side bolt unit in an expanded operating state according to the present disclosure.

As shown in FIG. 6, the side bolt unit 3 mainly includes the portal support 301, the retractable outer sleeve 302, the retractable inner sleeve 304, the retractable oil cylinder 303, the lifting oil cylinder 307, the second rotating oil cylinders (305, 309) and the side bolt drillers (306, 308). When a construction operation of side bolt is carried, the retractable inner sleeve 304 extends forward under the drive of the retractable oil cylinder 303 to reach the operating position. The side bolt drillers (306, 308) respectively rotate 90° outward under the drive of the second rotating oil cylinders (305, 309), then the drilling position is found exactly through the coordination between the back-and-forth retractable motion of the retractable inner sleeve 304 and the up-and-down lifting of the lifting oil cylinder 307, at the same time, two rows of bolt support at the upper end of the two sides are carried out, so the working efficiency is high. The portal support 301 straddles the upper rear end of the conveyor 107, and is mounted on the rear support body 105. This arrangement increases the length of the retractable outer sleeve 302 and the retractable inner sleeve 304, and then improve a retracting stroke. Under extreme conditions, the side bolt drillers (306, 308) are retracted to the tunneling position to carry out two rows of bolt support at the upper end of the two sides.

Figure 10:
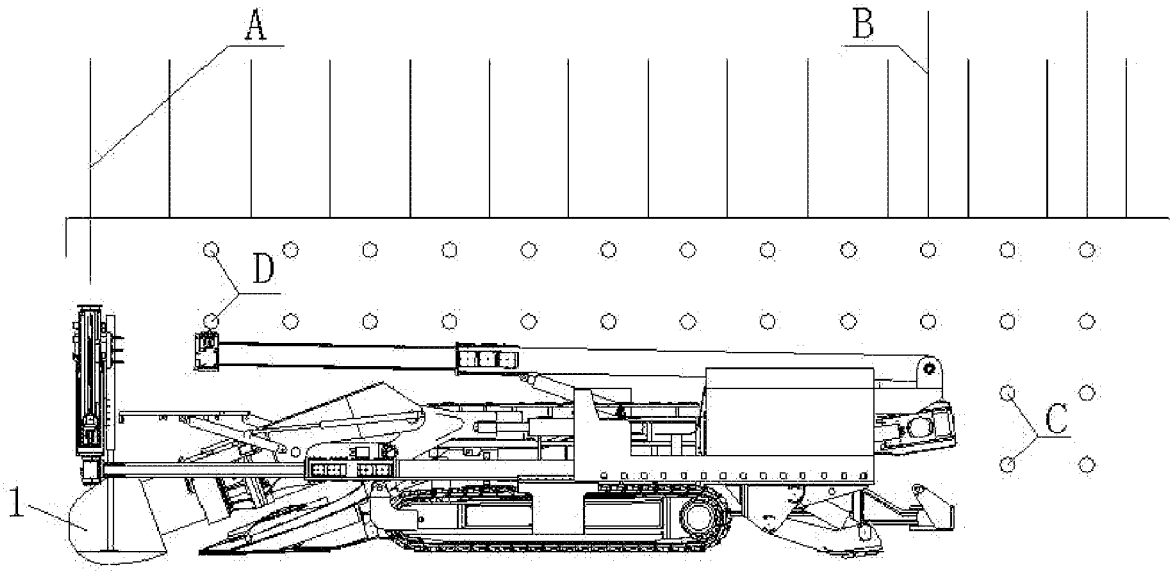
FIG. 10 illustrates a structure diagram of an embodiment of a six-arm tunneling and anchoring machine in a supporting operating state according to the present disclosure.

As shown in FIG. 7 and FIG. 8, the working platform group 4 mainly includes the large platform 404, the turning plates (405, 409), the retractable turning plates (406, 410), the connecting rod 402, the leveling oil cylinder 403, the second oil cylinder swinging back and forth 401, the turning plate oil cylinders (408, 411), and the retractable turning plate oil cylinders (407, 412). There are two leveling oil cylinders 403, which are arranged at two sides of the cutting part 103. The connecting rod 402 and one of the leveling oil cylinders 403 are arranged at the same side of the cutting part 103, while the other leveling oil cylinder 403 and the second oil cylinder swinging back and forth 401 are arranged at the other side of the cutting part 103. One end of the leveling oil cylinder 103 and one end of the connecting rod 402 are respectively hinged on the cutting part 103, and the other ends are hinged on the large platform. Four hinged points form a quadrilateral mechanism. The mechanism has simple structure and large forth and back swing amplitude, can adjust the height of the large platform 404, and realize, under the drive of the second oil cylinder swinging back and forth 401, the transition from the retracted state to the operating state of the working platform group 4. The turning plates (405, 409) rotate 90° outwards under the drive of the turning plate oil cylinders (408, 411), and the retractable turning plates (406, 410) extend and retract toward both sides under the drive of the retractable turning plate oil cylinders (407, 412). The large platform 404, the turning plates (405, 409) and the retractable turning plates (406, 410) constitute a large working platform, and the leveling oil cylinder 403 can adjust the large platform 404 at a horizontal position in real time according to the change of the upper and lower positions of the cutting part 103, thus greatly increasing the working range of the operators and improving the safety and comfort of the operators. In FIG. 10, A is roof bolt, B is anchor cable support, which can be constructed by the top anchor bolt or supplemented behind the side as required on site, C is the lower two rows of side bolts supplemented behind the side, and D is the upper two rows of side bolts. The forward, rear, left, right, up and down in the disclosure are defined relative to the heading direction of the six-arm tunneling and anchoring machine in operation.

The specific working processing is as follows.

Figure 9:
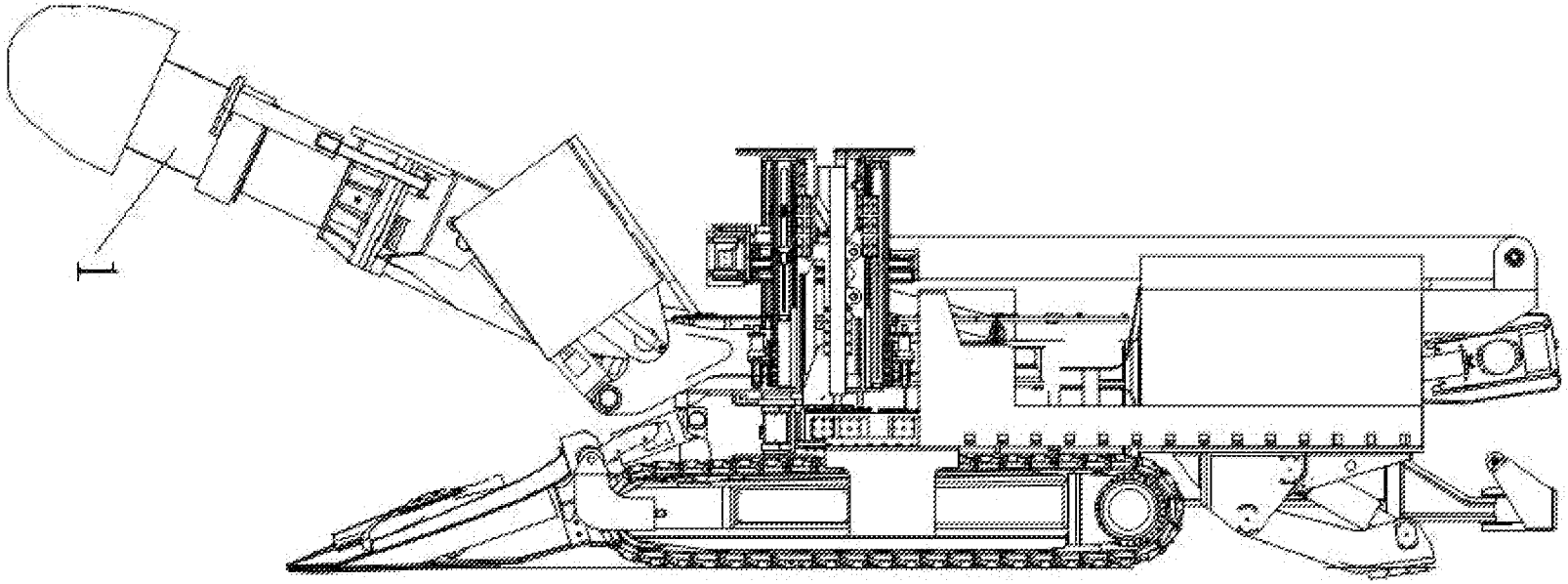
FIG. 9 illustrates a structure diagram of an embodiment of a six-arm tunneling and anchoring machine in a tunneling and cutting operating state according to the present disclosure.

1. When the tunneling machine 1 is in the working process of tunneling and cutting, the roof bolt unit 2, the side bolt unit 3 and the working platform group 4 are all in the retracted state, as shown in FIG. 9. After the working process of the tunneling machine 1 is completed, the cutting part 103 droops to prepare for bolt construction.

2. The left and right sets roof bolt units 2 start the preparation work before the support operation, the primary retractable sleeve 201 and the secondary retractable sleeve 212 slide forward respectively under the drive of the primary retractable oil cylinder 202 and the secondary retractable oil cylinder 203 to reach the operating position, and under the drive of the first rotating oil cylinder 211, the top anchor bolts (204, 209) rotate 90° inwards with the rotating base 213 to make the four top anchor bolts (204, 209, 214, 215) of the left and right top anchor bolt units 2 lined up, and then the support oil cylinder 206 extends out and effectively supports the base board.

3. The working platform group 4 swings forward under the drive of the second oil cylinder swinging back and forth 401 to reach the operating position; in this process, the leveling oil cylinder 403 performs real-time adjustment to make the large platform 404 at a horizontal position, then the turning plates (405, 409) rotate 90° outwards under the drive of the turning plate oil cylinders (408, 411), and the retractable turning plates (406, 410) extend and retract toward both sides under the drive of the retractable turning plate oil cylinders (407, 412).

4. The side bolt unit 3 extends forward under the drive of the retractable oil cylinder 303, and lifts up and down under the drive of the lifting oil cylinder 307 to reach the operating position, and then the side bolt drillers (306, 308) rotate 90° outward under the drive of the second rotating oil cylinders (305, 309) respectively.

5. The operator stands on the working platform group 4 to carry out the bolt support construction, and the left and right roof bolt units 2 and side bolt units 3 can operate independently or simultaneously according to the site conditions, thus greatly improving the working efficiency. The left and right roof bolt units 2 also carry out roof anchor cable construction.

6. After the bolt support operation is completed, the roof bolt unit 2, the side bolt unit 3 and the working platform group 4 retract to a folded state, and the tunneling machine 1 starts to work.

The above working process is operated manually or remotely.

In addition to the above description, it is noted that "an embodiment", "another embodiment", "embodiment", etc. in this specification mean that the specific features, structures or features described in combination with the embodiment are included in at least one generally described embodiment of the disclosure. The same statement appearing in more than one place in the specification does not necessarily refer to the same embodiment. Furthermore, when a specific feature, structure, or characteristic is described in combination with any embodiment, it is claimed that the realization of such feature, structure, or characteristic in combination with other embodiments also falls within the scope of the disclosure.

Each embodiment in the abovementioned embodiments is described with different emphases, and parts not specified in a certain embodiment may refer to related descriptions in the other embodiments.

The above is only the preferred embodiments of the present disclosure and not intended to limit the present disclosure; for those skilled in the art, the present disclosure may have various modifications and changes. Any modifications, equivalent replacements, improvements and the like within the spirit and principle of the disclosure should fall within the protection scope of the claims of the disclosure.

What is claimed is:

1. A six-arm tunneling and anchoring machine for integrating tunneling and anchoring, comprising a tunneling machine and a roof-bolter connected with each other, the roof-bolter comprising top anchor bolt units, a side bolt unit, and a working platform group, the tunneling machine comprising a frame body, a walking part, a cutting part, a revolving body, a rear support body, a loading mechanism, a conveyor, an electronic control system and a hydraulic system;

wherein, there are two sets of the top anchor bolt units, which are symmetrically arranged on a left side of the frame body and a right side of the frame body, and are located behind a revolving center of the revolving body; each roof bolt unit is provided with two sets of the top anchor bolt units; there is one side bolt unit, which is movably disposed on the frame body, and is located behind the cutting part; there are two side bolt drillers on the side bolt unit; the working platform group is connected with the cutting part, and is located above the cutting part;

wherein the side bolt unit further comprises a portal support, a retractable outer sleeve, a retractable inner sleeve, a retractable oil cylinder and a lifting oil cylinder;

wherein, the portal support is mounted on the rear support body, and straddles an upper rear end of the conveyor; the retractable outer sleeve is hinged on the portal support; one end of the retractable oil cylinder is hinged with the retractable outer sleeve, and the other end is hinged on the retractable inner sleeve; and one end of the lifting oil cylinder is hinged on the retractable outer sleeve, and the other end of the lifting oil cylinder is hinged on the frame body.

2. The six-arm tunneling and anchoring machine according to claim 1, wherein each of the two sets of the top anchor bolt units comprises a primary retractable sleeve, a secondary retractable sleeve, a primary retractable oil cylinder, and a secondary retractable oil cylinder;

wherein, the primary retractable sleeve slides back and forth along a guide rail and a support roller installed on the walking part, and the primary retractable sleeve and the secondary retractable sleeve are respectively driven by the primary retractable oil cylinder and the secondary retractable oil cylinder to do retractable motion back and forth.

3. The six-arm tunneling and anchoring machine according to claim 2, wherein each of the two sets of the top anchor bolt units further comprises a first rotating oil cylinder, a rotating base, a top anchor bolt, a first oil cylinder swinging back and forth, an oil cylinder swinging from side to side, a driller mounting base and a support oil cylinder;

wherein, the first rotating oil cylinder is mounted on a front end of the secondary retractable sleeve; the rotating base is connected with the first rotating oil cylinder; the first rotating oil cylinder is capable of driving the rotating base to rotate; the driller mounting base is hinged to the rotating base; the two top anchor bolts of each roof bolt unit are respectively hinged on the rotating base symmetrically through the driller mounting base; one end of the first oil cylinder swinging back and forth is hinged on the rotating base, and the other end of the first oil cylinder swinging back and forth is hinged on the driller mounting base; one end of the oil cylinder swinging from side to side is hinged on the driller mounting base, and the other end is hinged on the top anchor bolt; and the support oil cylinder is mounted on the rotating base.

4. The six-arm tunneling and anchoring machine according to claim 1, wherein the side bolt unit further comprises two second rotating oil cylinders; wherein the two second rotating oil cylinders are symmetrically mounted on left and right sides of a front end of the retractable inner sleeve, and the two side bolt drillers are respectively mounted on the second rotating oil cylinders.

5. The six-arm tunneling and anchoring machine according to claim 1, wherein the working platform group comprises a large platform, a connecting rod and a leveling oil cylinder;

wherein, one end of the connecting rod is hinged on the cutting part, and the other end of the connecting rod is hinged on the large platform; and one end of the leveling oil cylinder is hinged on the cutting part, and the other end of the leveling oil cylinder is hinged on the large platform.

6. The six-arm tunneling and anchoring machine according to claim 5, wherein the working platform group further comprises a turning plate, a retractable turning plate, a second oil cylinder swinging back and forth, a turning plate oil cylinder and a retractable turning plate oil cylinder;

wherein, one end of the second oil cylinder swinging back and forth is hinged on the cutting part, and the other end of the second oil cylinder swinging back and forth is hinged on the leveling oil cylinder; the turning plate is hinged with the large platform; the turning plate oil cylinder drives the turning plate to do turning motion; the retractable turning plate is built in the turning plate; and the retractable turning plate oil cylinder drives the retractable turning plate to do retractable motion relative to the large platform.

7. The six-arm tunneling and anchoring machine according to claim 6, wherein there are two turning plates, which are respectively disposed at a left side and a right side of the large platform movably.

8. The six-arm tunneling and anchoring machine according to claim 7, wherein there are two retractable turning plates, one of the two retractable turning plates is movably connected with the turning plate at the left side of the large platform, and the other of the two retractable turning plates is movably connected with the turning plate at the right side of the large platform.

9. The six-arm tunneling and anchoring machine according to claim 1, wherein the hydraulic system provides power to the tunneling machine and the roof-bolter.

* * * * *